US010054397B1

(12) United States Patent
Reimer

(10) Patent No.: US 10,054,397 B1
(45) Date of Patent: Aug. 21, 2018

(54) SELF-CORRECTING SCOPE

(71) Applicant: Paul Reimer, Seattle, WA (US)

(72) Inventor: Paul Reimer, Seattle, WA (US)

(73) Assignee: Paul Reimer, Seattle, WA (US)

( * ) Notice: Subject to any disclaimer, the term of this patent is extended or adjusted under 35 U.S.C. 154(b) by 579 days.

(21) Appl. No.: 14/690,436

(22) Filed: Apr. 19, 2015

(51) Int. Cl.
*F41G 1/38* (2006.01)
*F41G 1/473* (2006.01)

(52) U.S. Cl.
CPC ..... *F41G 1/38* (2013.01); *F41G 1/473* (2013.01)

(58) Field of Classification Search
CPC ... F41G 1/54; F41G 1/473; F41G 1/38; F41G 3/26; F41G 3/32; F41G 3/2605
See application file for complete search history.

(56) References Cited

U.S. PATENT DOCUMENTS 6,499,382 B1 * 12/2002 Lougheed ..... F41G 3/06 89/41.05
7,292,262 B2 * 11/2007 Towery ..... F41G 1/54 348/139
7,404,268 B1 * 7/2008 Page ..... F41G 1/38 42/126
7,926,219 B2 4/2011 Reimer
8,336,776 B2 * 12/2012 Horvath ..... F41G 1/38 235/400
8,459,552 B2 * 6/2013 Arbouw ..... F41G 3/06 235/400
8,651,381 B2 * 2/2014 Rudich ..... F41G 11/001 235/404
8,857,714 B2 * 10/2014 Benson ..... G05B 1/01 235/400
9,250,037 B2 * 2/2016 Seugnet ..... F41G 3/02
9,671,197 B2 * 6/2017 Levilly ..... F41G 5/06
9,733,047 B2 * 8/2017 Hancosky ..... F41G 1/54
9,746,286 B2 * 8/2017 Piepmeyer ..... F41G 1/473
2010/0301116 A1 * 12/2010 Bennetts ..... F41G 1/12 235/404
2011/0120438 A1 * 5/2011 Samuels ..... F41G 1/467 124/87
2011/0315767 A1 * 12/2011 Lowrance ..... F41G 3/02 235/404
2012/0126001 A1 * 5/2012 Justice ..... F41G 1/38 235/404
2012/0132709 A1 * 5/2012 Lowrey, III ..... F41C 27/22 235/407

(Continued)

FOREIGN PATENT DOCUMENTS

EP 1748273 A1 * 1/2007 ..... F41G 1/38

*Primary Examiner* — Benjamin P Lee
(74) *Attorney, Agent, or Firm* — Marshall, Gerstein & Borun LLP

(57) ABSTRACT

A self-correcting scope compares the original aim point of a projectile discharge device with the actual impact point and self-corrects the scope to account for the offset between these two points. The scope uses a typical optical lens which converts the incoming image to a digital image which is displayed by the invention on a digital display device which functions as the "eyepiece" of the scope. The invention also compresses the image either to the left or to the right or both of the field of interest in order to allow a shooter to be able to detect an intrusion into the field on interest from a point farther than can be achieved in a non-compressed image.

7 Claims, 7 Drawing Sheets

(56) References Cited

U.S. PATENT DOCUMENTS

| | | | | |
|---|---|---|---|---|
| 2012/0182417 | A1* | 7/2012 | Everett | F41G 1/30 348/135 |
| 2013/0169820 | A1* | 7/2013 | Stewart | H04N 5/225 348/169 |
| 2014/0002812 | A1* | 1/2014 | Kepler | G01B 11/272 356/138 |
| 2014/0110483 | A1* | 4/2014 | Benson | G05B 1/01 235/404 |
| 2014/0123531 | A1* | 5/2014 | Hancosky | F41G 1/54 42/113 |
| 2014/0124575 | A1* | 5/2014 | Millett | F41G 1/473 235/407 |
| 2014/0319215 | A1* | 10/2014 | Farca | F41G 1/38 235/404 |
| 2015/0041538 | A1* | 2/2015 | Teetzel | F41A 23/08 235/404 |
| 2015/0345905 | A1* | 12/2015 | Hancosky | F41G 1/35 42/113 |
| 2016/0047624 | A1* | 2/2016 | Hancosky | F41G 1/54 42/113 |

* cited by examiner

SELF-CORRECTING SCOPE

BACKGROUND OF THE INVENTION

1. Field of the Invention

The present invention relates to a scope, such as a scope used on a projectile discharge device, such as a firearm, paintball gun, bow and arrow system, etc., wherein the scope provides digital imaging output to the user such that after the projectile discharge device is discharged, the scope calculates the offset between the aim point of the scope and the actual impact point of the fired round and recalibrates the scope based on the offset.

2. Background of the Prior Art

Some firearm users are able to initially sight a firearm in, often at an indoor range where wind is not a factor, at a given distance, and thereafter use the sighted in firearm under almost any condition. Such users are sufficiently adept at using firearms so that they can calculate the offsets presented by wind, distance differential (from the distance used at sight in), load being shot, humidity, etc., and use the firearm with great accuracy. Such firearms users are also able to take a non-sighted-in firearm, and after a small number of benchmark shots, understand the offsets inherent in sighting of the particular firearm, and are able to mentally make the necessary corrections and shoot very accurately.

Unfortunately, many firearms users, as well as users of other projectile discharge devices, such as paintball guns, BB guns, bow and arrow systems, etc., are not as skilled in firearm usage and tend to be less accurate in their shooting. In order to improve the shooting accuracy of such shooters, as well as to increase the high accuracy rate of highly skilled shooters, scopes are used on the firearm. A typical scope magnifies the image presented to the user and usually places some form of reticle, such as a crosshair or concentric target circles, onto the target being aimed at.

This magnification of the target area, coupled with the provision of the reticle for centering onto the target, improves the accuracy rate of most shooters, some more than others. While increasing accuracy, missed shots still abound, Many shooters, once a shot is fired and the degree of off target impact of the projectile is identified, are able to mentally calculate the offset and come closer to the target, if not dead on, with the next shot. However, many shooters lack either the visual acuity or the spatial understanding to effectively mentally calculate their shooting error and are not able to effectively account for the error. Additionally, many shooters, possibly faced with a strong cross wind, simply feel uncomfortable aiming the scope off target in order to compensate for the wind and will bring the scope back on target, only to miss the target from the wind effects. Similar problems arise for distance shots when accounting for gravitational effects.

For shooters that can quickly and effectively calculate their shot error and compensate their sighting through the scope with the next shot, the few seconds such calculation and compensation require, many be problematic. While a shooter at a gun range may have time on his or her hands, a hunter shooting game 100 yards away who takes a few seconds to correct for his or her next shot, will find the game disappearing into the brush. For a soldier on the battlefield, the time delay for error compensation may prove fatal.

What is needed is a device that allows a shot error to be identified and compensated so that the next shot, if fired properly, gets on target as intended. Such a device must be relatively easy to use and must perform its compensation task with speed so that a shooter can quickly compensate for shot error and get on target for the next shot. Such a device must be relatively easy to install onto a projectile discharge device and be relatively easy to setup and use.

SUMMARY OF THE INVENTION

The self-correcting scope of the present invention addresses the aforementioned needs in the art by providing a scope that is mounted onto a projectile discharge device such as a firearm, a paintball gun, a BB gun, a bow of a bow and arrow system, etc., and which automatically provides correction for a user for the upcoming shot based on the data captured from the previous shot. The self-correcting scope, having a physical mounting profile that mimics a traditional optical scope, mounts to the projectile discharge device in typical fashion and is used for aim purposes in typical scope fashion, although the user looks at a display screen as opposed to looking through an ocular eyepiece. This makes the self-correcting scope relatively easy to install and easy to setup and maintain. The self-correcting scope is of relatively simple design and construction, being produced using standard manufacturing techniques, so as to make the device readily affordable to a large segment of potential consumers of this type of device. In field use, the self-correcting scope is easy to utilize and very quick so that once shot correction is needed, the function is performed very fast in order to allow a corrected subsequent shot to be discharged in order to hit the intended target before the target disappears or before the target gets its own shot off in the direction of the user.

The self-correcting scope of the present invention is comprised of a scope body that has an optical lens that receives light. The scope body is mounted onto the projectile discharge device in appropriate fashion. A computer has a storage device, while an image display device is communicatively coupled to the scope body and to the computer such that the light captured by the optical lens is displayed on the image display device as an image. The image is also recorded on the storage device by the computer. The image display device has a centering point located thereon such that at the moment the projectile discharge device discharges the projectile at an aim point, the image displayed on the image display device has the centering point superimposed over the aim point. Thereafter the computer locates the impact point and superimposes the aim point over the impact point by shifting the image on the image display device, the difference between the aim point and the impact point being an offset. The centering point on the image display device remains stationary. The centering point on the image display device is part of a reticle such that the shape of the reticle is variable by the user. The light captured by the optical lens passes through a semi-transparent mirror wherein the light is split into a first light path that is received by the image display device and a second light path that is received by the computer. A buffer is communicatively coupled to the computer so that the image received by the computer is continually buffered in order to be able to calculate the offset. An accelerometer is coupled to the computer, such that when the projectile discharge device discharges the projectile, the accelerometer measures a deflection of the projectile discharge device which is communicated to the computer, the computer using the deflection to calculate the offset. The image displayed on the image display device is displayed in a left field panel, a center panel, and a right field panel such that the left field panel, the center panel and the right field panel are located side-by-side to one another (the center field panel being medial) and wherein the portion of the image within the left field panel is visually compressed or the portion of the image within the right field panel is visually compressed or both.

BRIEF DESCRIPTION OF THE DRAWINGS

Similar reference numerals refer to similar parts throughout the several views of the drawings.

DESCRIPTION OF THE PREFERRED EMBODIMENT

Figure 1:
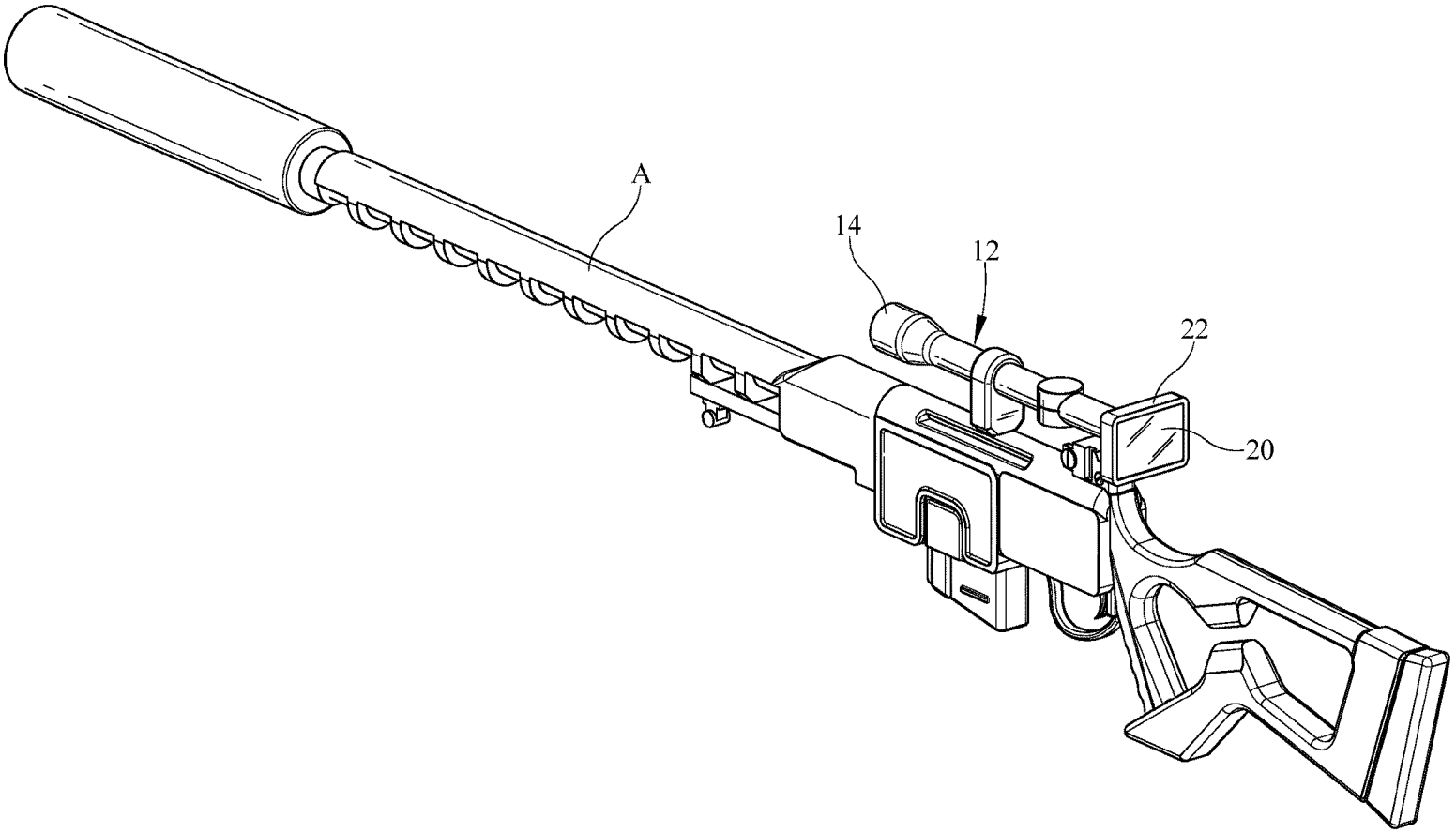
FIG. 1 is a perspective view of the self-correcting scope of the present invention mounted onto a typical projectile discharge device in the form of a long gun.
Figure 2:
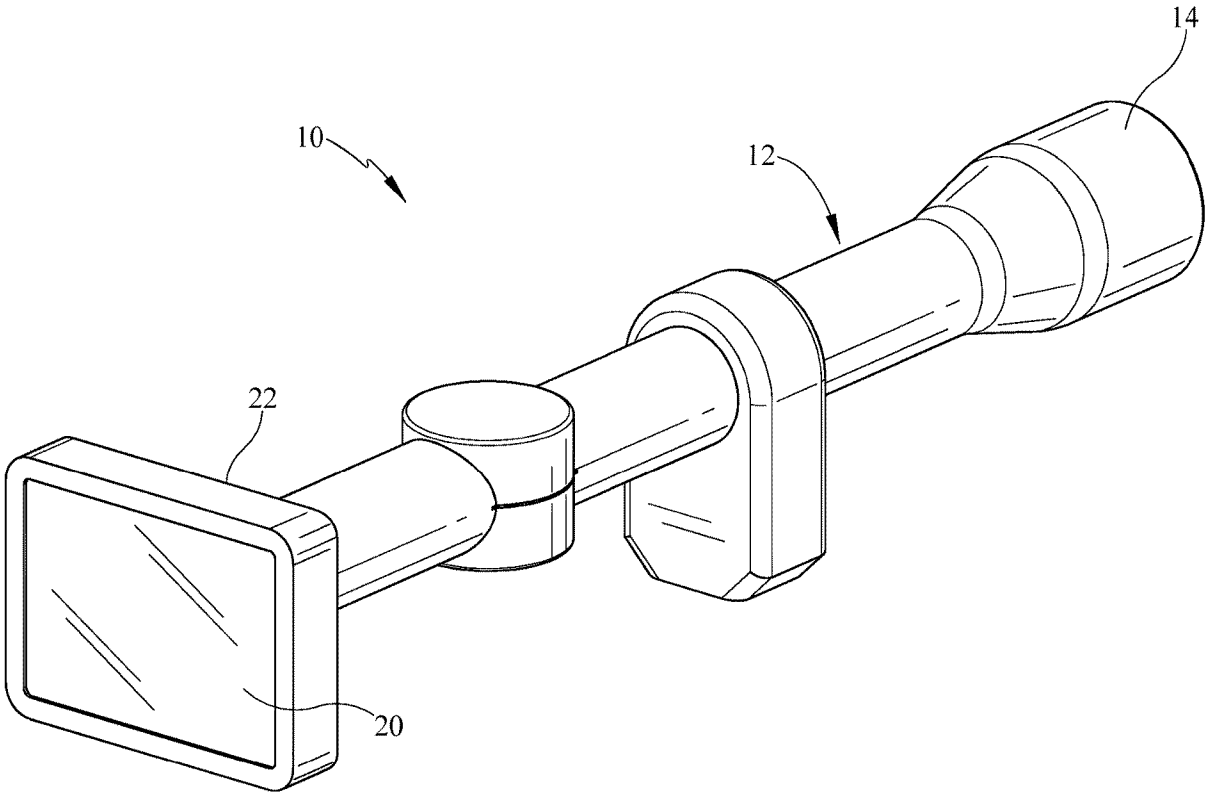
FIG. 2 is a perspective view of the self-correcting scope.
Figure 3:
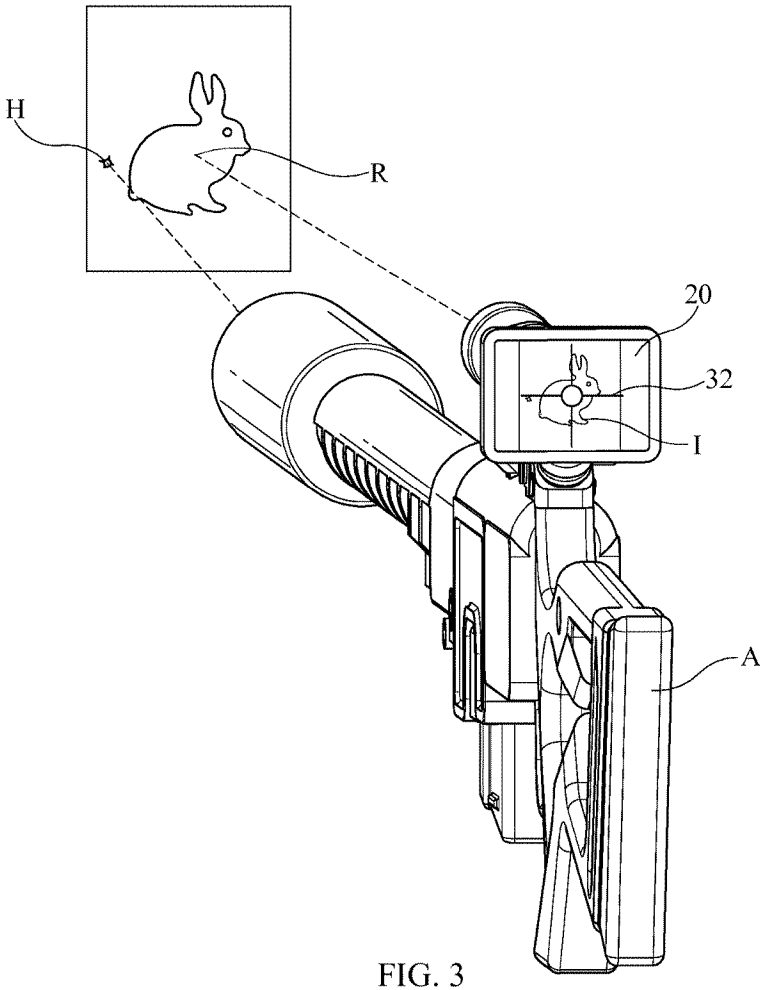
FIG. 3 is a perspective view of the self-correcting scope mounted onto the projectile discharge device from a shooter's perspective showing the aim point of the scope versus the actual impact of the projectile discharged from the projectile discharge device.
Figure 4:
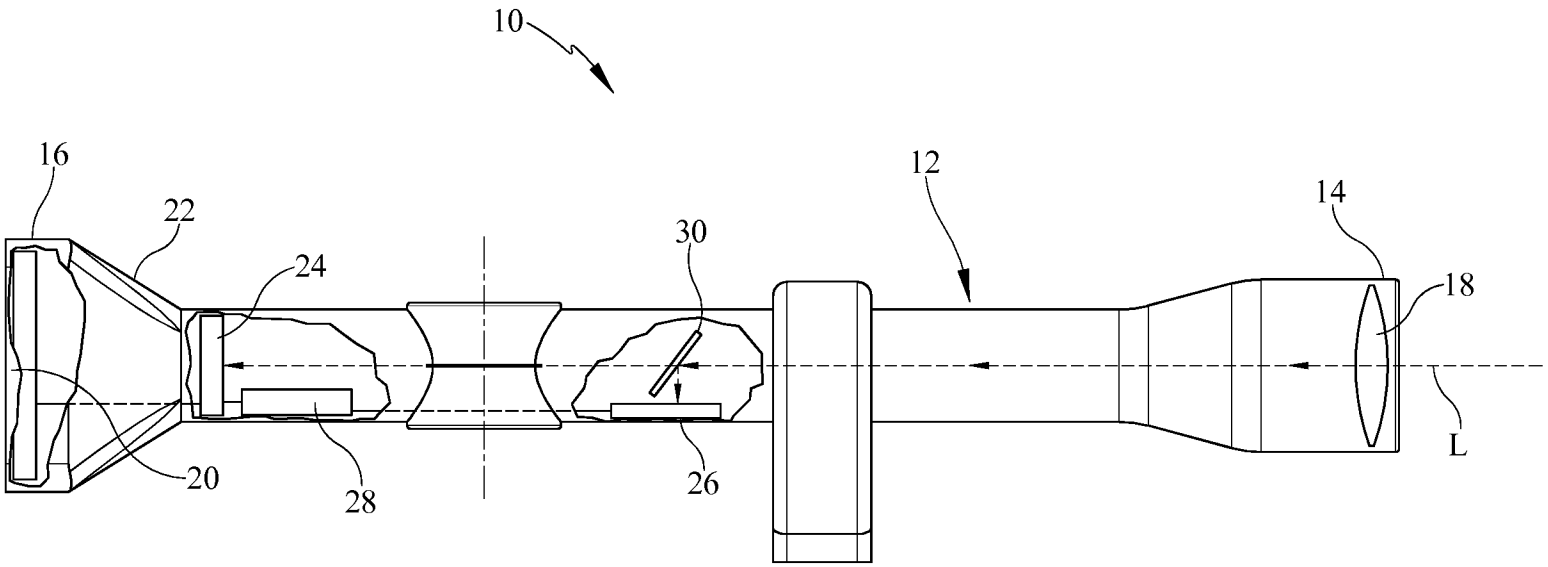
FIG. 4 is an elevation view partially cutaway, of the self-correcting scope illustrating the main internal components of the present invention.
Figure 5B:
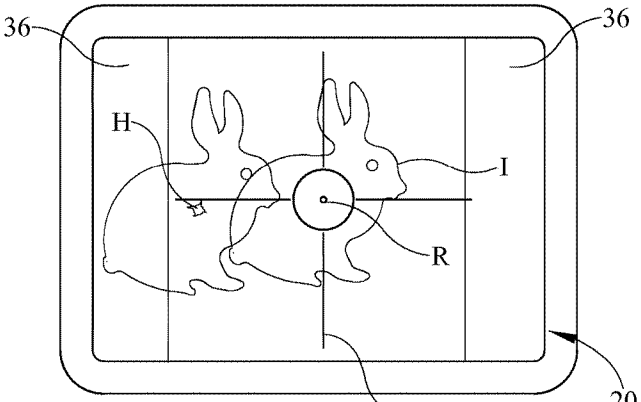
FIGS. 5*a*-5*d* illustrate the progression of the self-correcting function of the self-correcting scope from the initial shot taken to the subsequent shot to be taken.
Figure 5D:
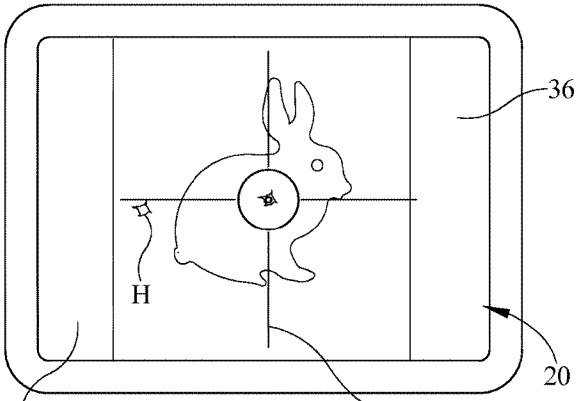
Figure 5A:
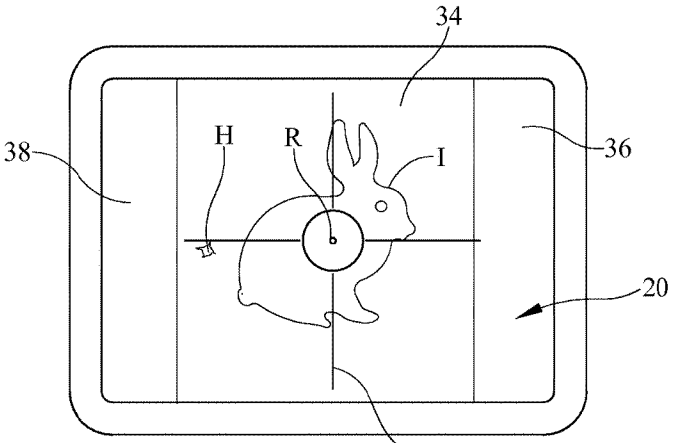
Figure 5C:
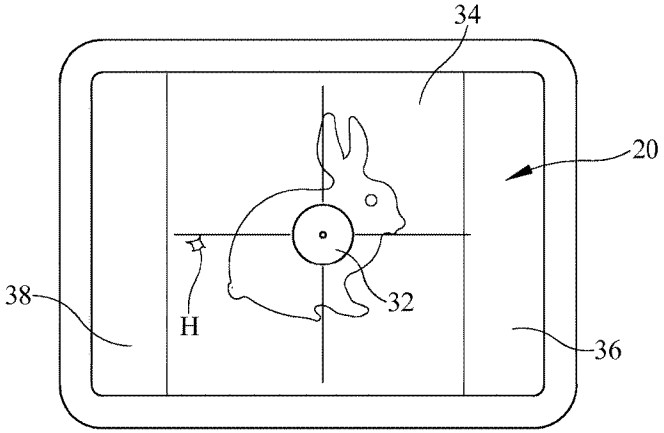

Referring now to the drawings, it is seen that the self-correcting scope of the present invention, generally denoted by reference numeral 10, is comprised of a scope body 12 that has a first end 14 and a second end 16 such that an optical lens 18 is disposed within the first end 14 of the scope while an image display device 20 is located on the second end 16 of the device. The digital display device 20, which is a typical digital display screen, and which may be a touch screen display of appropriate design, and may be held in a housing 22 that is pivotally attached to the remainder of the scope body 12 in order to allow the housing 22 and thus the display device 20 to be able to pivot with respect to the remainder of the scope body 12.

A first digital image sensor 24 is located within the scope body 12 as is a second digital image sensor 26, each in signal processing communication with a computer 28 also located within the scope body 12. The computer 28 has storage capacity and may have at least one accelerometer in communication with the computer 28. A semi-transparent mirror 30 is located within the scope body 12.

Light L enters the scope body 12 through the optical lens 18 and passes through the mirror 30 wherein a portion of the light L is passed through to the first digital image sensor 24 and a portion of the light L is reflected onto the second digital image sensor 26, each digital image sensor of appropriate design (such as a charge-coupled device or a complementary metal-oxide-semiconductor). The first digital image sensor 24 converts the light L into a digital visual image I that is displayed on the display device 20 in real time, while the second digital image sensor 26 converts the light L into a digital visual image (which can be either a still image and/or a video stream as desired by the user) that is recorded via the computer 28 onto the computer's storage device. Basically, the scope body 12 functions as a digital camera with the exception of the use of two digital image sensors 24 and 26. The use of two digital image sensors 24 and 26 as opposed to one such sensor lies in the need to have a continuous real time digital image I displayed on the display device 20 without the lag that is occasioned by recording and storing digital files of the display on the computer's storage device. While the self-correcting scope can work with a single digital image sensor providing images for the display device 20 as well as for recording via the computer 28, the lags for recording may prove unsatisfactory to many. The overall length of the scope body 12 is based on the desired focal length of the scope between the lens 18 and the mirror 30 with the optical geometry of the lens 18 being consistent with such length as is well known in the field of optics.

An appropriate battery (not illustrated) is disposed within the scope body 12 for providing a source of electric power for the computer 28, the digital image sensors 24 and 26, and the display device 20 and any other electrical or electronic accoutrements that are attached to the scope body 12 (such as, for example, a light or infrared sensor (neither illustrated) on the first end 14 of the scope body 12 for nighttime use), the battery may be rechargeable.

In typical use, the scope body 12 is mounted to a projectile discharge device, such as the illustrated rifle A, a pistol P, a paintball gun, a BB or other type of pellet gun, a bow of a bow and arrow system or crossbow system, etc., and the scope body 12 is used as a digital scope in the usual way. The projectile discharge device A is pointed down range and the image seen I is passed through the lens 18 to the two digital image sensors 24 and 26, with the former 24 displaying the captured image I on the display device 20 and the latter 26 passing the image data to the computer where the image data is stored. Zoom and fade functions may also be provided for the image I displayed on the display device 20, as well as other typical image controls such as brightness adjustment, etc., as are well known in the art. The computer 28 can store the image data as a continuous image stream, a video, or as one or more still images, such that the images can be captured at regular intervals, which interval length can be set by the user, or upon demand of a user who depresses an image capture button, either a physical button (not illustrated) located on the scope body 12, advantageously proximate the display device 20, or via an onscreen button on the display device 20, or upon firing of the projectile discharge device, such that when the projectile discharge device is fired, muzzle deflection occurs, the muzzle deflection event is captured by the accelerometer which communicates with the computer 28 to capture the digital image being captured by the second digital image sensor 26, alternately, the firing event can be captured by a small pressure transducer located just beyond the muzzle and communicatively coupled to the computer 28, located proximate the discharge end of the muzzle, the pressure transducer reading the pressure from the muzzle blast and communicating this pressure change to the computer 28 to indicate that a firing has occurred. The capture regiment is controlled by the user with appropriate menus (not illustrated) displayed on the display device 20 and manipulated either through physical control buttons or onscreen virtual control buttons. Of course other more sophisticated methods of determining firing can be used, such as sensor switches on the trigger or firing pin. An image buffer continuously captures images therein so that when a firing event is detected, the images (still or video) just prior to the firing event are available for processing. Captured images can also be downloaded in appropriate fashion such as by connecting an appropriate cable, such as a USB fitted cable to the scope body 12 and to the download capture device, Wi-Fi, etc., and the captured images can have the typical metadata attached thereto, such as date and time, GPS location, etc.

The computer 28 superimposes on the image I displayed on the display device 20 a reticle 32 which can be a simple crosshair reticle 32 as illustrated or can be a myriad of other styles of reticles 32 such as concentric target circles, etc., the reticles 32 being resident with the computer 28 with additional reticles being either self-designable within the self-correcting scope 10 or can be designed on and downloaded from a computer to the onboard computer 28 in appropriate fashion similar to the fashion of transferring captured images to an external device. When using the self-correcting scope 10 the user is able to select the desired reticle 32.

In self-correcting mode of the self-correcting scope 10, the user aims the projectile discharge device with the reticle 32 positioned onto the target and the image of this aim point captured by the computer 28 via the second digital image sensor 26 either via continuous or discrete image recording or upon discharge of the projectile discharge device. Once the projectile discharge device fires, the impact point H of the discharged round is determined. Such impact point H determination is made by having the user aim the scope at the impact point H (reticle 32 centered thereon) and having the accelerometer determine the movement of the projectile discharge device from its initial aim point, through muzzle deflection, to final movement to the actual impact point H. Alternately, the software of the computer 28 can determine from image comparisons the image of the initial aim point R to the final impact point H and determine the offset therefrom. The self-correcting scope 10 may be equipped with appropriate software that is able to detect the final impact point H relieving the user from having to aim the scope body 12 thereon after projectile discharge.

The computer 28 takes the initial aim point R of the scope and the actual impact point H of the projectile and calculates the offset between the two. The computer 28 then recalibrates the scope so that the aim point for the subsequent shot is corrected for the offset—if the projectile discharge device remains aimed at precisely the initial aim point R, then the computer recalibrates the scope to have the crosshairs 32 or other reticle pointed at the actual impact point H for the subsequent shot.

Recalibration of the scope is achieved in any desired fashion. One scenario is that the user fires the initial shot and onboard sensors detect the actual impact point H and self-correct the scope for the subsequent shot, either completely automatically or with a confirmation to so self-correct. Alternately, the user takes the initial shot and lines the scope up on the actual impact point H and has the computer 28 calculate the offset in order to recalibrate the subsequent shot.

As also seen, the image I image displayed on the display device 20 may have what are essentially three lateral or side-by-side panels, a central image panel 34, a right field panel 36 and a left field panel 38. The right field panel 36 and/or the left field panel 38 may be visually compressed, so that an image portion that is displayed within the appropriate display panel 36 and/or 38 is compressed so that a larger field of view is achievable within the overall image displayed by the display device 20. The purpose of such image compression is to maximize the field of view. For example, a shooter using his or her right eye for aim purposes may want to strongly compress the right field panel 36 while providing little or no compression for the left field panel 38. The shooter, by being right-eyed, has a certain amount of right field peripheral vision from his or her right eye so that this peripheral vision, coupled with a non-highly compressed or even non-compressed right field panel 36 allows the shooter to be able to detect an intrusion into the area monitored by the right field panel display 36. Such intrusion may include a bad actor upon whom the shooter is able to respond. The left field panel 38 display is substantially more compressed so that the shooter can see an intrusion earlier in the game (highly compressed means that the outer boundary of the left most captured image is relatively farther away) and take appropriate countermeasures. Of course, some right-eyed shooters may want just the opposite of compressing the right field panel 36 and not compressing the left field panel 38. Right panel 36 and left panel compression 38 is controlled by the user via the computer 28 either via an onscreen (display device 20) control system or via appropriate physical buttons (as stated, not illustrated).

Figure 6:
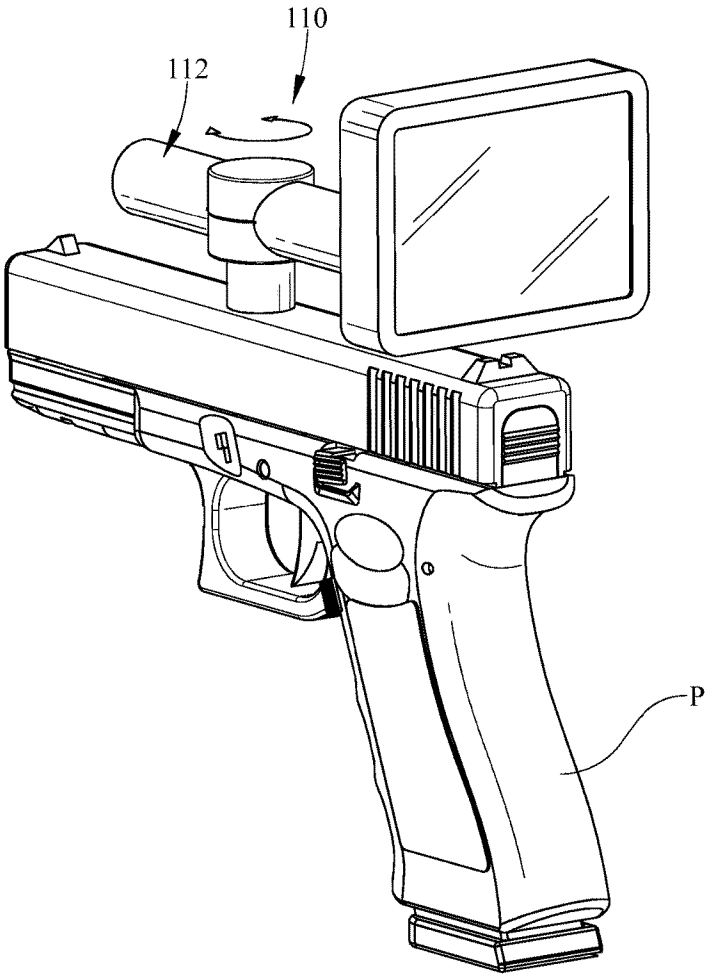
FIG. 6 is a perspective view of the self-correcting scope of the present invention mounted onto a typical projectile discharge device in the form of a handgun.
Figure 7:
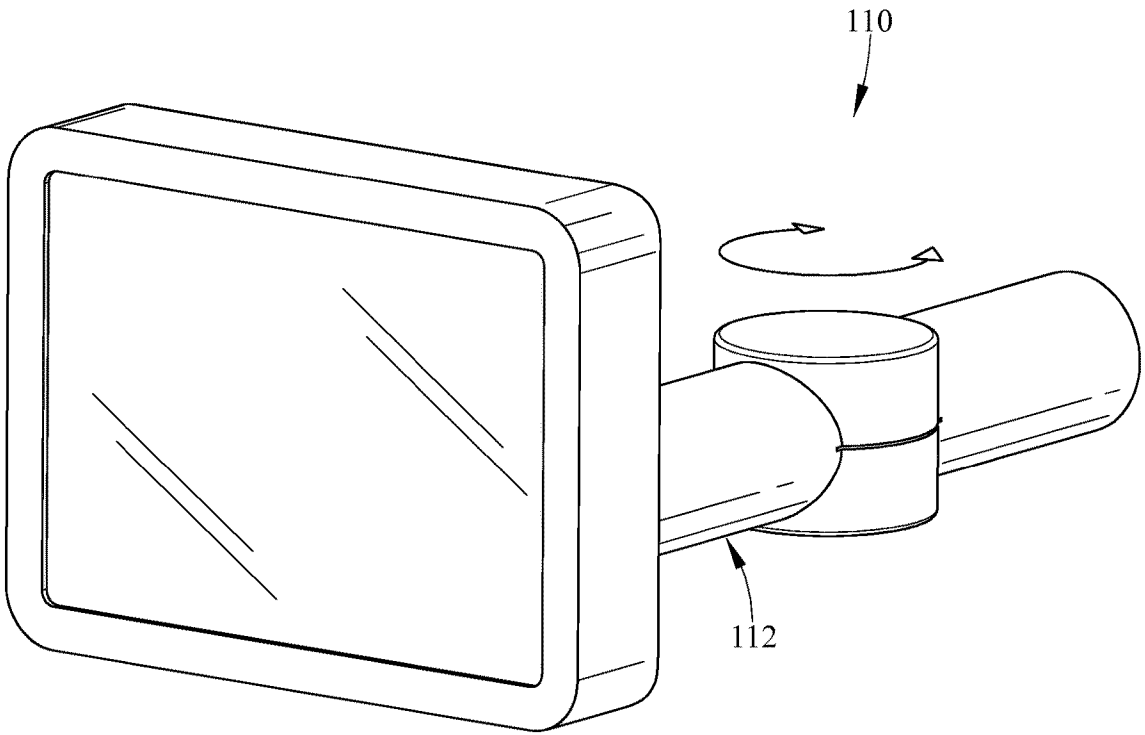
FIG. 7 is a perspective view of the self-correcting scope of FIG. 6.

As seen in FIGS. 6 and 7, the self-correcting scope 110 of the present invention may have a shorter scope body 112 for use in mounting on a smaller discharge device such as the illustrated pistol P. This version of the self-correcting scope 110 works in identical fashion to the previously described version of the self-correcting scope 10, the only difference being the overall length of the device.

While the invention has been particularly shown and described with reference to an embodiment thereof, it will be appreciated by those skilled in the art that various changes in form and detail may be made without departing from the spirit and scope of the invention.

I claim:

1. A self-correcting scope for a projectile discharge device that fires a projectile, the projectile hitting an impact point after being discharged by the projectile discharge device, the self-correcting scope comprising:

a scope body having an optical lens that receives light, the scope body adapted to be mounted to the projectile discharge device;

a computer having a storage device; and an image display device communicatively coupled to the scope body and to the computer such that the light captured by the optical lens is displayed on the image display device as an image, the image also recorded on the storage device by the computer, the image display device having a centering point located thereon such that at the moment the projectile discharge device discharges the projectile at an aim point, wherein the image displayed on the image display device is displayed in a left field panel, a center panel, and a right field panel such that the left field panel, the center panel and the right field panel are located side-by-side to one another and such that a first portion of the image is displayed within the left field panel, a second portion of the image is displayed within the center field panel and a third portion of the image is displayed within the right field panel and wherein the third portion of the image is visually compressed, and the image displayed on the image display device has the centering point superimposed over the aim point, and thereafter the computer locates the impact point, the computer calculates an offset based on the difference between the aim point and the impact point, and superimposes the aim point over the impact point using the offset by shifting the image on the image display device.

2. The self-correcting scope as in claim 1 wherein the centering point on the image display device remains stationary.

3. The self-correcting scope as in claim 2 wherein the centering point on the image display device is part of a reticle.

4. The self-correcting scope as in claim 3 wherein a shape of the reticle is variable.

5. The self-correcting scope as in claim 4 wherein the light captured by the optical lens passes through a semi-transparent mirror wherein the light is split into a first light path that is received by the image display device and a second light path that is received by the computer.

6. The self-correcting scope as in claim 5 further comprising a buffer wherein at the image received by the computer is buffered.

7. The self-correcting scope as in claim 6 further comprising an accelerometer coupled to the computer, such that when the projectile discharge device discharges the projectile, the accelerometer measures a deflection of the projectile discharge device which is communicated to the computer, the computer using the deflection to calculate the offset.

* * * * *